US008857063B2

(12) United States Patent
Koike

(10) Patent No.: US 8,857,063 B2
(45) Date of Patent: Oct. 14, 2014

(54) ROTARY ELECTRIC SHAVER

(75) Inventor: Hideaki Koike, Matsumoto (JP)

(73) Assignee: Izumi Products Company, Nagano (JP)

( * ) Notice: Subject to any disclaimer, the term of this patent is extended or adjusted under 35 U.S.C. 154(b) by 489 days.

(21) Appl. No.: 13/007,122

(22) Filed: Jan. 14, 2011

(65) Prior Publication Data

US 2011/0173815 A1 Jul. 21, 2011

(30) Foreign Application Priority Data

Jan. 15, 2010 (JP) ..... 2010-006863

(51) Int. Cl.
*B26B 19/14* (2006.01)

(52) U.S. Cl.
CPC ..... *B26B 19/14* (2013.01); *B26B 19/145* (2013.01)
USPC ..... 30/43.4; 30/43.5; 30/43.6

(58) Field of Classification Search
CPC .... B26B 19/14; B26B 19/141; B26B 19/143; B26B 19/145
USPC ..... 30/43.4–43.6
See application file for complete search history.

(56) References Cited

U.S. PATENT DOCUMENTS

| | | | | |
|---|---|---|---|---|
| 3,844,033 | A * | 10/1974 | Yonkers | 30/43.5 |
| 4,168,570 | A | 9/1979 | Bakker et al. | |
| 5,625,950 | A | 5/1997 | Sterk et al. | |
| 5,687,481 | A * | 11/1997 | De Boer et al. | 30/43.6 |
| 6,647,626 | B2 * | 11/2003 | Nakano | 30/43.4 |
| 7,152,324 | B2 * | 12/2006 | Uchiyama | 30/43.6 |
| 7,222,428 | B2 * | 5/2007 | Koike | 30/43.5 |
| 7,487,592 | B2 * | 2/2009 | Koike | 30/43.4 |
| 7,530,171 | B2 * | 5/2009 | Baron et al. | 30/43.6 |
| 7,743,508 | B2 * | 6/2010 | Shimizu | 30/43.6 |
| 8,393,082 | B2 * | 3/2013 | Shimizu | 30/43.6 |
| 2002/0062565 | A1 * | 5/2002 | Uchiyama et al. | 30/43.6 |
| 2006/0260130 | A1 * | 11/2006 | Shimizu | 30/43.6 |
| 2010/0275446 | A1 * | 11/2010 | Schmitt et al. | 30/43.4 |
| 2013/0180112 | A1 * | 7/2013 | Koike | 30/43.5 |

FOREIGN PATENT DOCUMENTS

| | | | |
|---|---|---|---|
| CA | 2505231 | A1 * | 10/2005 |
| CA | 2520608 | A1 * | 3/2006 |
| EP | 1 208 951 | A2 | 5/2002 |
| EP | 1591211 | A1 * | 11/2005 |

(Continued)

OTHER PUBLICATIONS

EP Communication, dated Apr. 21, 2011, issued in corresponding EP Application No. 11150906.3, 6 pages.

*Primary Examiner* — Jason Daniel Prone
(74) *Attorney, Agent, or Firm* — Sughrue Mion, PLLC

(57) ABSTRACT

A rotary electric shaver provided with a plurality of cutter units, each of which has an outer cutter (72) and an inner cutter (84), which rotates while elastically contacting the outer cutter from below. The shaver comprising: a plurality of outer cutter assemblies (70), each of which is made integral with a cutter circumferential rim (74) having the outer cutter of each cutter unit secured thereto and which is movably retained in a mounting port formed in the cutter frame (66), a pushup plate (92) which contacts the outer cutter assembly from below to push up the outer cutter assembly, a cutter retaining plate (90) which is retained by the cutter frame and which is positioned below the pushup plate, and an outer cutter float spring (94) which is compressively interposed between the cutter retaining plate and the pushup plate to impart an upward return tendency to the pushup plate. Each outer cutter can independently move, thus ensuring smooth vertical movement or rocking of the outer cutter and also permitting an increased shaving area.

8 Claims, 9 Drawing Sheets

(56) References Cited

FOREIGN PATENT DOCUMENTS

| | | | | |
|---|---|---|---|---|
| EP | 1637293 | A1 | * | 3/2006 |
| EP | 1 779 983 | A1 | | 5/2007 |
| EP | 1 862 271 | A1 | | 12/2007 |
| EP | 2 246 159 | A2 | | 11/2010 |
| EP | 2 281 670 | A1 | | 2/2011 |
| EP | 2345516 | A1 | * | 7/2011 |
| EP | 2614937 | A1 | * | 7/2013 |
| JP | 09-503424 | A | | 4/1997 |
| JP | 2005312523 | A | * | 11/2005 |
| JP | 2006087509 | A | * | 4/2006 |
| JP | 2011143101 | A | * | 7/2011 |
| JP | 2013141566 | A | * | 7/2013 |
| WO | 96/02368 | A1 | | 2/1996 |

* cited by examiner

ROTARY ELECTRIC SHAVER

BACKGROUND OF THE INVENTION

1. Field of the Invention

The present invention relates to a rotary electric shaver in which a cutter frame held by a shaver main body is provided with a plurality of cutter units, each of which includes an outer cutter and an inner cutter to be rotated while bringing the inner cutter into resilient contact with the outer cutter from below.

2. Description of the Related Art

In this type of electric shaver, when a substantially discoid outer cutter is pressed against skin with a high pressing force, the outer cutter tends to deeply dig into the skin, undesirably causing excessively deep shaving or an excessive pressure of contact between the outer rim of the outer cutter and the skin, possibly resulting in discomfort of the user of the shaver. As a solution thereto, it has conventionally been proposed to surround the outer periphery of the outer cutter by a cutter circumferential rim (skin supporting rim) so as to prevent the contact pressure between the outer cutter and skin from becoming excessive (refer to JP 09-503424(T).

In the rotary electric shaver disclosed in the aforesaid JP 09-503424(T) (corresponding to WO 96/02368, U.S. Pat. No. 5,625,950 and EP 0719203A), the cutter circumferential rim (skin supporting rim) is movably retained relative to a cutter frame, and the outer cutter is movably retained relative to the cutter circumferential rim. When the outer cutter is brought into firm contact with skin, the skin around the outer cutter depresses the cutter circumferential rim, so that the contact pressure is distributed between the outer cutter and the cutter circumferential rim, thus reducing the contact pressure applied to the outer cutter.

The aforesaid patent also discloses adjoining cutter circumferential rims connected with a hinge to prevent the heights of the adjoining cutter circumferential rims from becoming significantly uneven thereby to ensure that the shaving surface of a head unit smoothly slides along a curved skin surface.

The rotary electric shaver disclosed in the aforesaid JP 09-503424(T) poses a problem in that, since the outer cutter is movable relative to the cutter circumferential rim, increasing the travel amount (the amount of depression or the amount of rocking) of the outer cutter causes the edge of the outer cutter to be easily caught by the opening rim of an outer cutter mounting port of the cutter circumferential rim. More specifically, the outer cutter is inserted from below into the outer cutter mounting port of the cutter circumferential rim, and the flange of the outer cutter engages the inner edge of the outer cutter mounting port of the cutter circumferential rim. Therefore, firmly pressing the outer cutter against skin causes the outer cutter to deeply dig into the cutter circumferential rim.

Further, since adjoining cutter circumferential rims are connected with a hinge, a vertical movement, a rocking or a circular movement of one cutter circumferential rim causes an adjacent cutter circumferential rim to move up and down or rock, preventing each cutter circumferential rim from independently moving. In other words, when one outer cutter moves down or rocks along an uneven skin surface, the adjacent cutter circumferential rim and the outer cutter also moves down or rocks together, adversely affecting the performance of the adjacent outer cutter.

Further, more members interlock with the vertical movement or rocking movement of a single outer cutter, resulting in higher resistance applied to a vertical travel of the subject outer cutter. In addition, the presence of the hinged structure between cutter circumferential rims inevitably leads to a smaller outside diameter of the outer cutter or a smaller shaving area of the head unit, i.e., the total area of the shaving surfaces of the individual outer cutters. On the other hand, increasing the outside diameter of the outer cutter would increase the size of the cutter frame.

SUMMARY OF THE INVENTION

The present invention has been accomplished under the circumstances as aforementioned, and an object thereof is to provide a rotary electric shaver which restrains an outer cutter from being caught by the inner edge of a mounting port of a cutter circumferential rim when the outer cutter moves down, enables each outer cutter to move independently without affecting the movements (e.g., downward movement or rocking) of adjoining cutter circumferential rims, ensures smooth movement of a head unit even when adjacent cutter circumferential rims come to differ in height or tilt, ensures smooth vertical movement or rocking of the outer cutter with low resistance, and permits a larger shaving area.

According to the present invention, the aforesaid object is achieved by a rotary electric shaver in which a plurality of cutter units having an outer cutter and an inner cutter is installed to a cutter frame retained on a shaver main body, the inner cutter being rotated while bringing the inner cutter into resilient contact with the inner surface of the outer cutter, the rotary electric shaver comprising:

a plurality of outer cutter assemblies, each of which is made integral with a cutter circumferential rim having the outer cutter of each cutter unit secured thereto, the respective outer cutter assembly being movably retained in a mounting port formed in the cutter frame;

a pushup plate which contacts said outer cutter assembly from below to push up the outer cutter assembly;

a cutter retaining plate which is retained by the cutter frame and which is positioned below the pushup plate; and an outer cutter float spring which is compressively interposed between the cutter retaining plate and the pushup plate to impart an upward restoring tendency to the pushup plate.

According to the present invention, the outer cutter and the cutter circumferential rim are integrally secured, so that the outer cutter will not move down or tilt or rock in relation to the cutter circumferential rim and will not be caught by the cutter circumferential rim. Moreover, each of the plurality of outer cutter assemblies having the outer cutter and the cutter circumferential rim combined into one piece is movably retained in the mounting port provided in the cutter frame. This arrangement restrains adjacent outer cutter assemblies from interfering with each other when they move, thus preventing the performance of adjacent outer cutters from being adversely affected.

Furthermore, each outer cutter assembly is independent from other assemblies, so that the movement of an outer cutter assembly does not cause the remaining outer cutter assemblies to vertically move or rock and does not lead to an increased resistance applied to a vertical movement of the subject outer cutter assembly. In addition, even if the difference in height or tilt between adjoining outer cutters increases, the cutter frame provided between the adjoining cutter circumferential rims accommodate such difference, thus allowing the head unit to smoothly move or slide on the shaving surface of skin.

Thus, the need for the hinge structure among the cutter circumferential rims is obviated, making it possible to increase the diameters of the outer cutters so as to increase the shaving area. In other words, increasing the diameters of the outer cutters will not result in a larger cutter frame.

Each of the plurality of outer cutter assemblies may be attached to the mounting port of the cutter frame such that the outer cutter assembly can be rocked on a rocking axis which is orthogonal to a straight line extending from the center of the cutter frame in a radial direction (in the direction from the center of the cutter frame to the shaving surface of the outer cutter) and which passes the center of the outer cutter. In this case, a pair of engaging hooks may be protrusively provided in the vicinity of the rocking axis of the outer cutter assembly and positioned symmetrically with respect to the center of the outer cutter, and the engaging hooks may be locked on the mounting port of the cutter frame from below.

In the case where three outer cutter assemblies are retained by the cutter frame, the outer cutter assemblies may be arranged such that the centers of the three outer cutters are positioned at the apexes of an equilateral triangle in relation to the center of the cutter frame. In the case where two outer cutter assemblies are retained, the outer cutter assemblies may be arranged such that the centers of the outer cutters are positioned symmetrically with respect to the center of the cutter frame. The rotary electric shaver in accordance with the present invention is most desirably provided with three outer cutter assemblies. Alternatively, however, the rotary electric shaver may include two or three or more outer cutter assemblies.

The outer cutter assembly may simply rock such that the edge of the assembly adjacent to the center of the cutter frame moves down. Alternatively, however, the whole outer cutter assembly may move or slide down. For example, each outer cutter assembly may be constructed so as to lock, from below, the engaging hooks, which is provided on the cutter circumferential rim to install the assembly to the mounting port of the cutter frame, onto the edge of the mounting port of the cutter frame such that the assembly is free to move down or sink.

The pushup plate, which pushes up each of the outer cutter assemblies, is elastically supported upward by an outer cutter float spring compressively interposed between the pushup plate and the cutter retaining plate retained by the cutter frame. A removable plate, which is free to rotate about the central axis of the cutter frame (the axis which is perpendicular to the upper surface of the cutter frame or the shaving surface and which passes the center of the cutter frame), is retained by the cutter retaining plate, so that the removable plate can be engaged with or disengaged from the inner surface of the cutter frame. For example, a projection provided on the peripheral edge of the removable plate may be disengageably locked onto to a fixing rib secured to (or integrally formed with) the cutter frame such that the projection is engaged or disengaged in the circumferential direction.

The cutter retaining plate held against the inner surface of the cutter frame may be formed integrally with an inner cutter fall proof ring for preventing the inner cutter of each cutter unit from falling off. More specifically, the ring prevents the inner cutter from falling off the cutter unit when the head unit in which the cutter unit has been installed to the cutter frame is attached to or detached from the main body, thus ensuring easy installation and removal of the head unit.

The pushup plate preferably abuts against the bottom surface of the cutter circumferential rim of each outer cutter assembly at an edge thereof adjacent to the center of the cutter frame and resiliently pushes up each cutter circumferential rim at an edge thereof adjacent to the center of the cutter frame. In this case, the cutter circumferential rim may be made rockable, and the reset rocking position of the cutter circumferential rim may be restricted by engaging or disengaging the edge of the cutter circumferential rim adjacent to the outer periphery of the cutter frame with or from the cutter frame.

In the case where a rotary electric shaver has three cutter unit, there is a void among three inner cutter fall proof rings formed integrally with the cutter retaining plates. The void efficiently accommodates the pushup plate, the outer cutter float spring and the like coaxially on the central axis of the cutter frame. This arrangement is ideally suited to reduce the size of the head unit.

DESCRIPTION OF THE PREFERRED EMBODIMENTS

Figure 1:
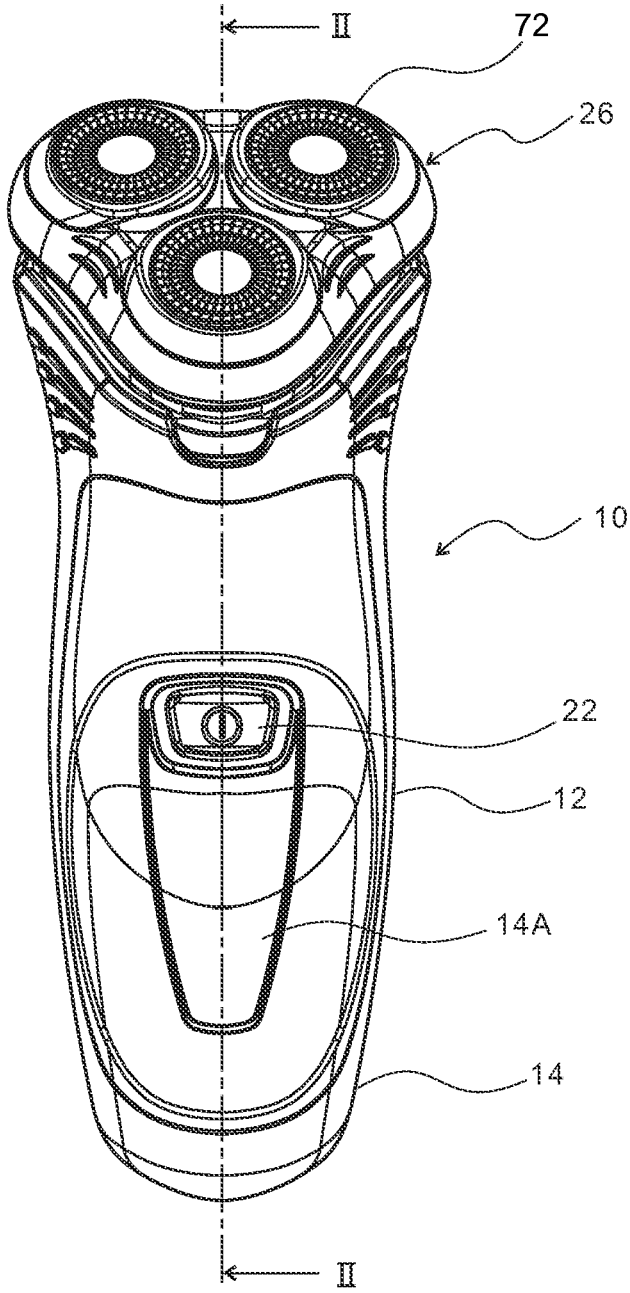
FIG. 1 is a perspective exterior view of a rotary electric shaver according to an embodiment of the present invention.
Figure 2:
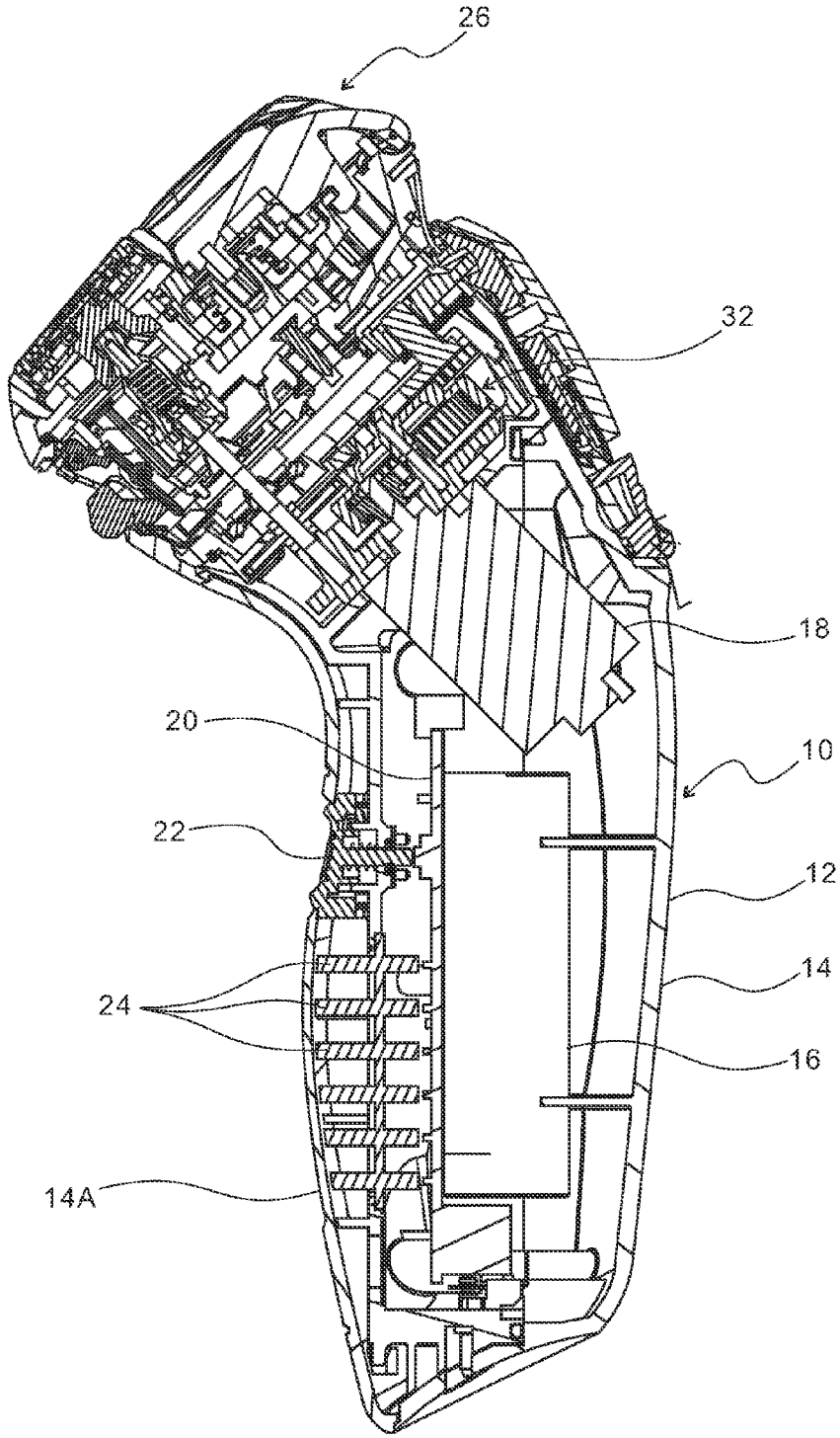
FIG. 2 is a sectional view taken at line II-II in FIG. 1.

Referring to FIG. 1 to FIG. 4, a shaver main body 10 includes a case 14, in which a substantially columnar grip 12 has its upper portion bent obliquely upward toward the front. The case 14, the front and back of which can be separated, houses therein a chargeable battery 16, an electric motor 18, a control circuit board 20, and the like, as illustrated in FIG. 2. A power switch 22 is mounted on the front surface of the case 14. Below the switch 22, displays 24 composed of LED lamps indicating the remaining battery power level of the battery 16, an operation mode and the like are provided such that the displays 24 can be visually seen through a translucent portion 14A of the case 14.

A head unit 26 is detachably mounted on the top of the case 14 such that the head unit 26 can be opened and closed. The head unit 26 is tilted relative to the grip 12 of the case 14 such that the shaving surface thereof (the upper surface of a cutter frame 66, which will be described hereinafter) is oriented obliquely upward to the front. The rotation output shaft of the electric motor 18 is oriented toward the head unit 26.

Figure 3:
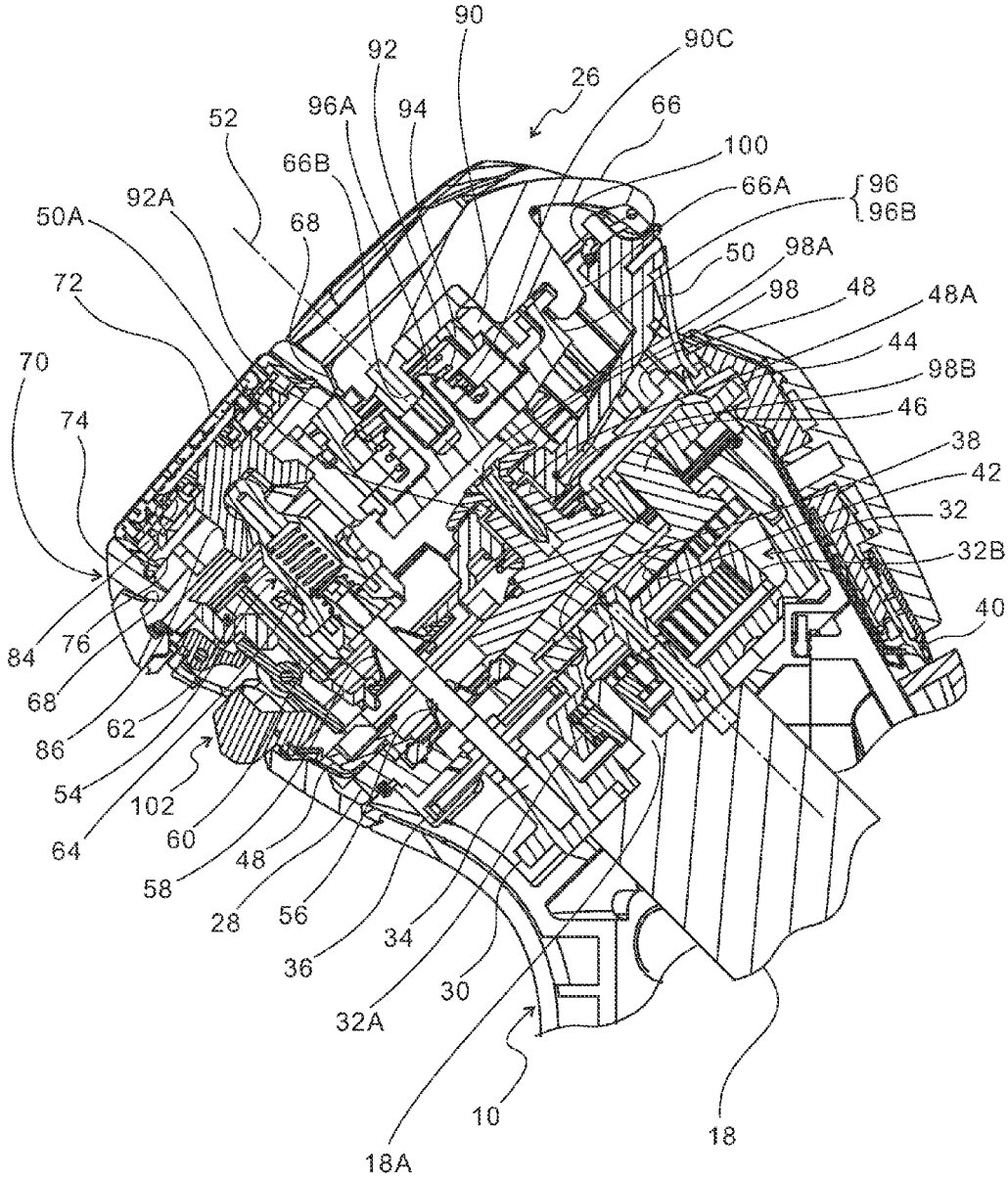
FIG. 3 is an enlarged sectional view of a part of FIG. 2.

A reduction gear assembly 32 is placed between an inner top cover plate 28 covering the top of the main body 10 and an inner bottom cover plate 30 securing the electric motor 18, as illustrated in FIG. 3. The reduction gear assembly 32 reduces the rotational speed of a rotation output shaft 18A of the motor 18 by a small gear 32A and an inner cutter large gear 32B and transmits the reduced speed to three inner cutter drive shafts 34 through a large spur gear 36. The bottom end of each of the inner cutter drive shafts 34 is rotatably supported by the inner bottom cover plate 30, and the middle portion thereof penetrates the inner top cover plate 28 into the head unit 26.

The respective large spur gears 36 secured to the three inner cutter drive shafts 34 meshes a gear formed on the top surface of the inner cutter large gear 32B. An eccentric cylindrical cam 38 is formed integrally with the top surface of the inner cutter large gear 32B, and drives an edge-trimming cutter 40. More specifically, a cam follower 42 which engages the cam 38 to rock is integral with a supporting point portion 46 of a trimmer drive lever 44 which penetrates an inner top cover plate 28 and rocks, and causes the trimmer drive lever 44 to laterally swing. When the edge-trimming cutter 40 is raised, the trimmer drive lever 44 is engaged in the edge-trimming cutter 40 to cause the edge-trimming cutter 40 to reciprocate.

A waterproof plate 48 is secured to the top surface of the inner top cover plate 28 of the main body 10, and a substantially bowl-shaped head holder 50 is retained above the waterproof plate 48 such that the head holder 50 is slightly rockable. The aforesaid three inner cutter drive shafts 34 are positioned at the apexes of the equilateral triangle, the center of which is the central axis 52 of the head unit 26 (refer to FIGS. 3 to 7). As described above, the bottom portions of the inner cutter drive shafts 34 are rotatably supported by the inner bottom cover plate 30, and the middle portions thereof extend upward, penetrating the inner top cover plate 28, the waterproof plate 48 and the head holder 50. Universal joints 54 are mounted on the upper ends of the inner cutter drive shafts 34.

Substantially conical flexible sealants 56 and 58 are installed between the inner cutter drive shafts 34 and the waterproof plate 48 and the head holder 50, as illustrated in FIG. 3. The universal joint 54 has a connecting drive shaft 60 secured to the upper end of the inner cutter drive shaft 34, a connecting driven shaft 62 slidably retained in an axial direction relative to the connecting drive shaft 60, and a coil spring 64 compressively installed between the drive shaft 60 and the driven shaft 62. The upper end of the connecting driven shaft 62 is provided with a spherical portion, the top plan view of which is substantially quadrangular. The spherical portion is inserted from below into a substantially quadrangular concavity 88 and movably engages the concavity 88. The concavity 88 is formed in a boss 86 of an inner cutter 84, which will be discussed later, and opens downward.

Figure 4:
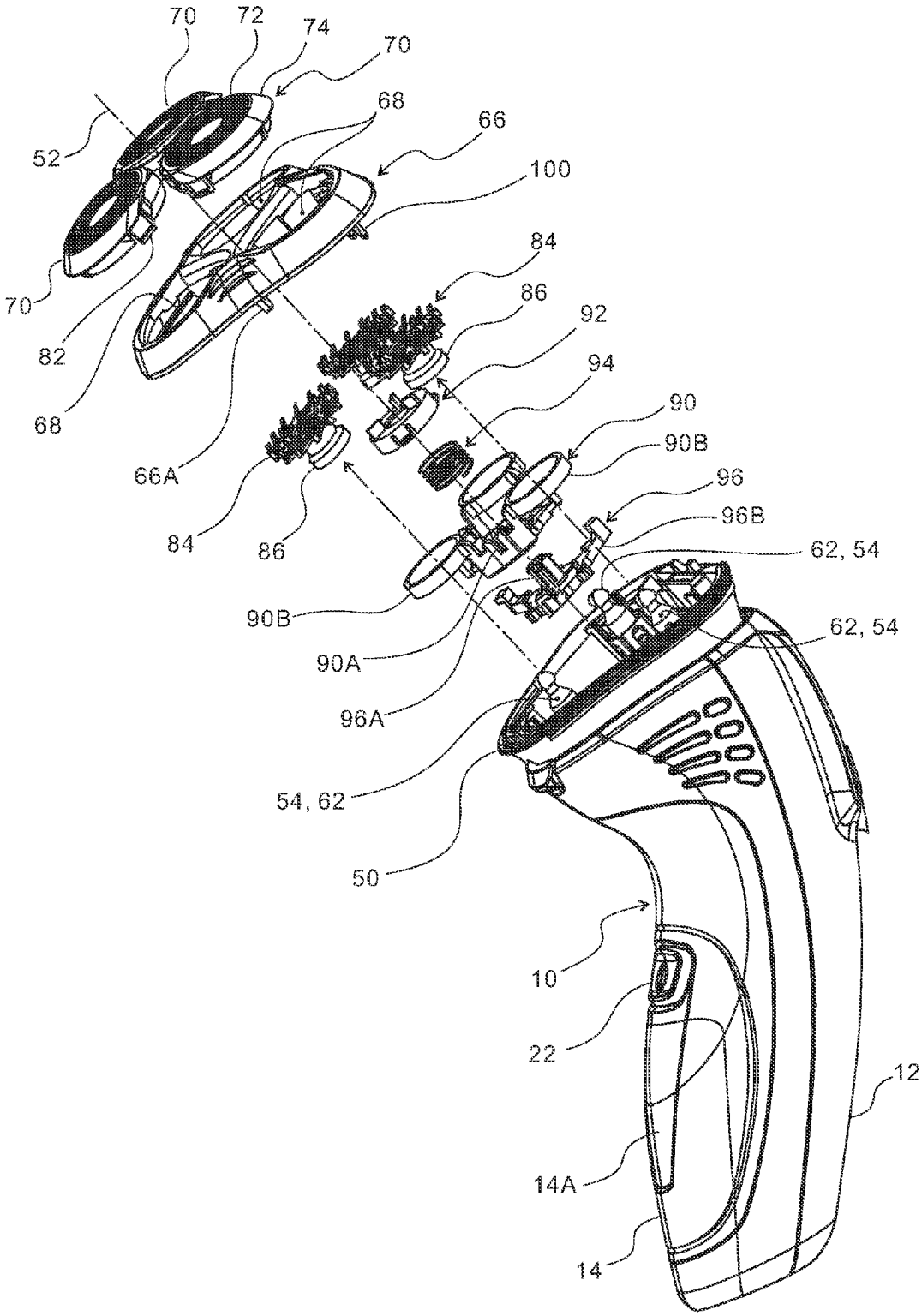
FIG. 4 is an exploded perspective view of a head unit of the electric shaver in FIG. 1.

The head unit 26 will now be described. In the head unit 26, three cutter units are attached to the cutter frame 66, which can be opened upward and which is mounted on the head holder 50. The cutter frame 66 is substantially triangular as observed in the front view thereof, and the periphery thereof is gently curved downward. The cutter frame 66 has three circular mounting ports 68, as illustrated in FIGS. 3 and 4, in which the outer cutter assemblies 70 are movably retained.

Figure 6:
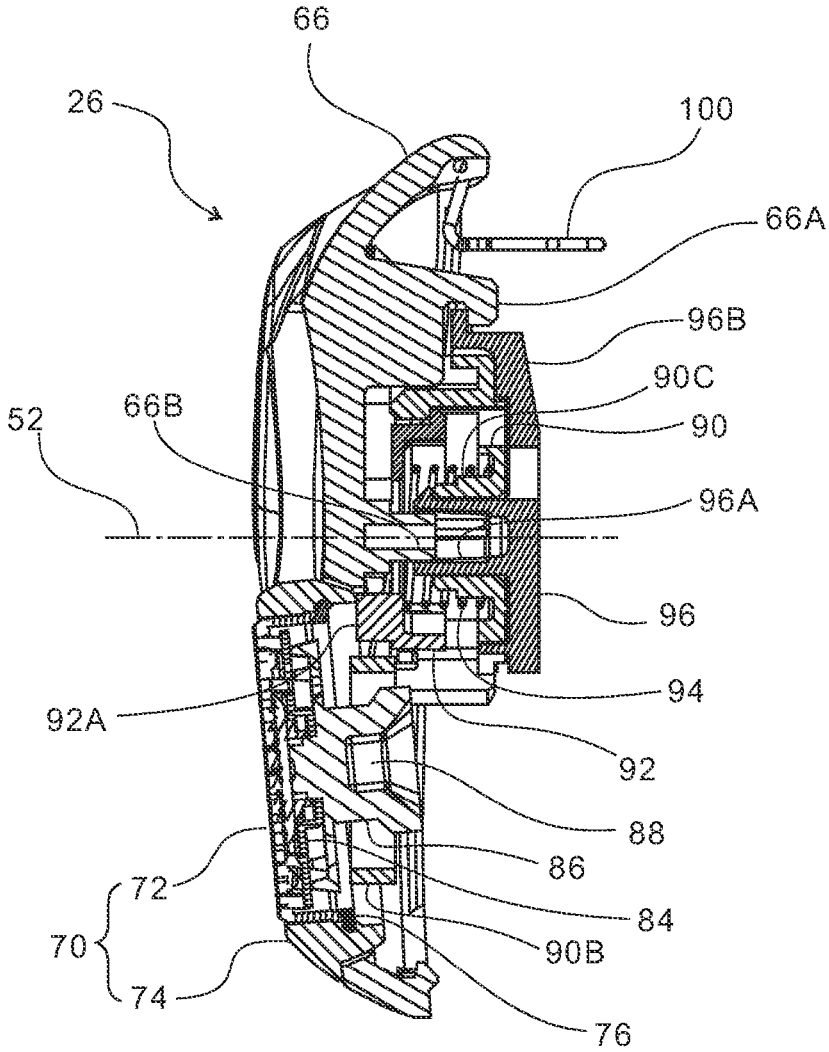
FIG. 6 is a sectional view taken at line VI-VI in FIG. 5.
Figure 8:
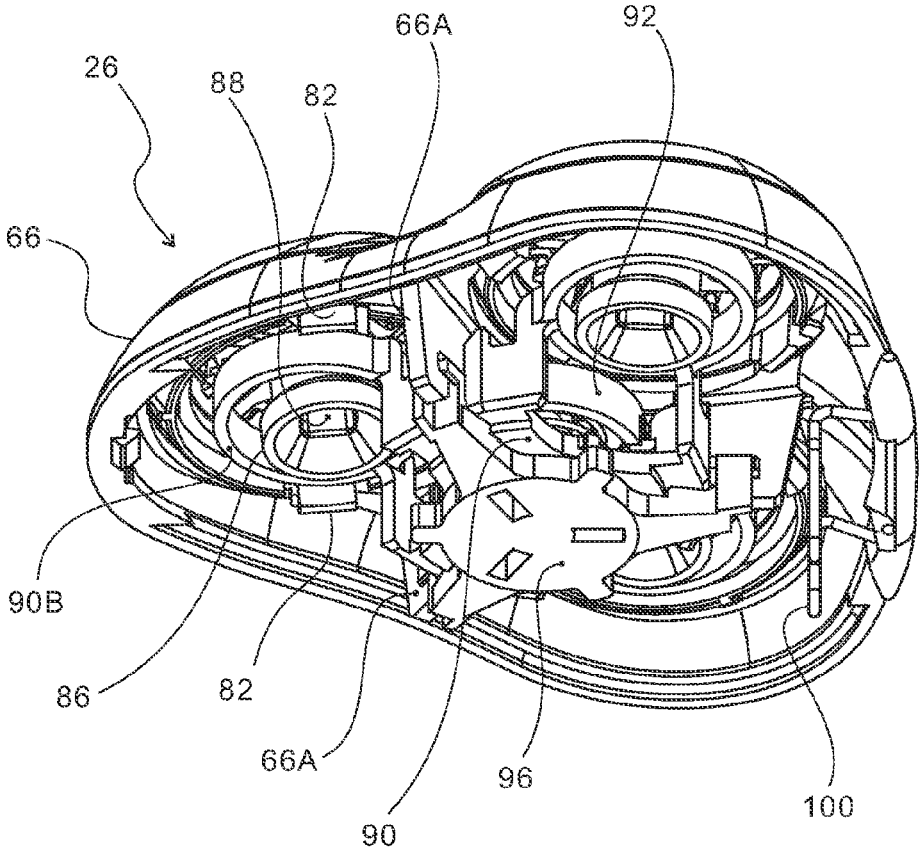
FIG. 8 is a perspective view of the interior of the head unit of the electric shaver in FIG. 1 observed obliquely from below.
Figure 9:
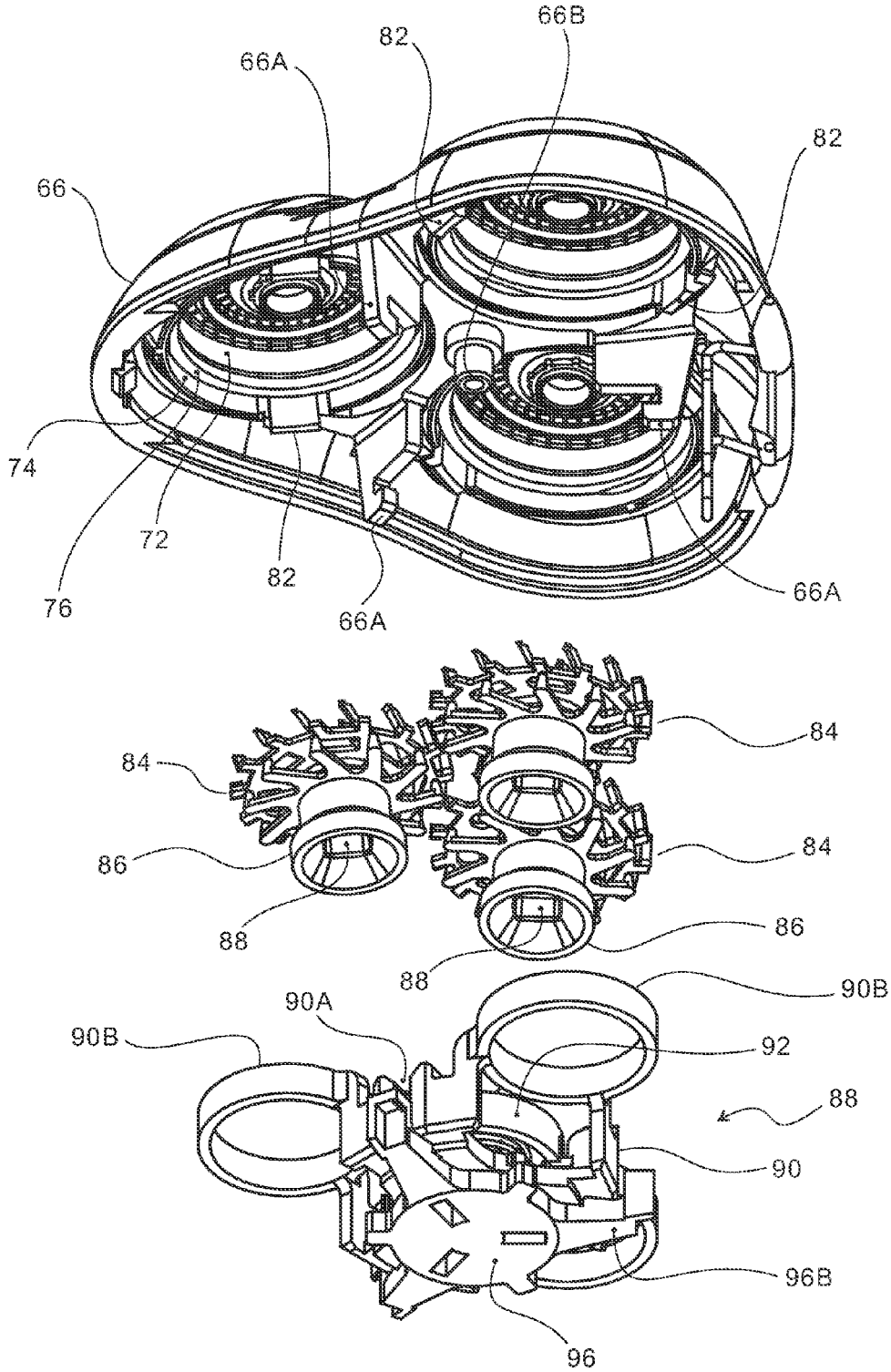
FIG. 9 is an exploded perspective view of the interior of the head unit of the electric shaver in FIG. 1 observed obliquely from below.

More specifically, each of the outer cutter assemblies 70 includes an outer cutter 72 which is substantially discoid and the rim of which is folded downward, a cutter circumferential rim 74 in which the outer periphery of the outer cutter 72 is fitted, and a stopper ring 76 which is fitted in the inner periphery of the cutter circumferential rim 74 to fix the outer cutter 72 to the cutter circumferential rim 74 (refer to FIGS. 3, 6 and 9). The top surface of the outer cutter 72 has many hair introduction openings arranged in the radial direction, the top surface jutting out slightly beyond the cutter circumferential rim 74.

Figure 5:
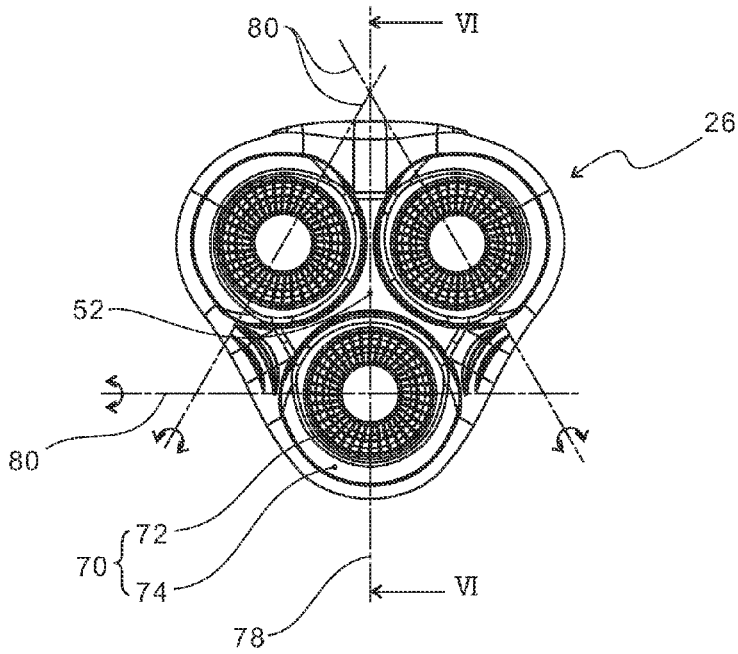
FIG. 5 is a top plan view of the appearance of the head unit of the electric shaver in FIG. 1.
Figure 7:
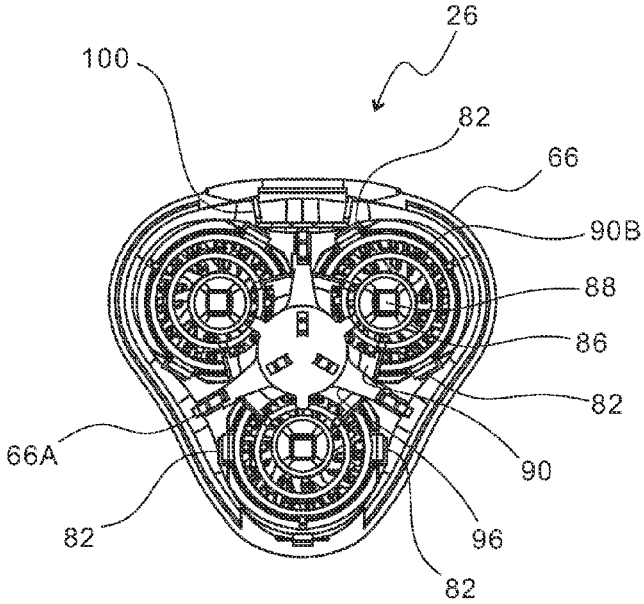
FIG. 7 is a bottom view illustrating the interior of the head unit of the electric shaver in FIG. 1.

As illustrated in FIG. 3, the inner circumferential surface of each of the mounting ports 68 of the cutter frame 66 is formed of a spherical surface, the diameter of which increases upward, and the outer circumferential surface of the cutter circumferential rim 74 is formed of a spherical surface matching the spherical surface of the inner circumferential surface of the mounting port 68. The cutter circumferential rim 74 has a pair of engaging hooks 82 (see also FIG. 4, illustrating engaging hooks), which are positioned symmetrically to each other and which are protrusively provided downward in the vicinity of the straight line, i.e., the rocking axis 80, which is orthogonal to a straight line 78 passing the center of the cutter frame 66, i.e., the central axis 52 of the head unit 26 (only one of the straight lines 78 is shown in FIG. 5) and which passes the center of the outer cutter 72 (refer to FIGS. 4, 5 and 7).

The engaging hooks 82 engage the bottom rim of the mounting port 68 when the outer cutter assembly 70 is pushed into the mounting port 68 of the cutter frame 66 from above. Thus, the outer cutter assembly 70 is allowed to rock about the rocking axis 80, using a point in the vicinity of the engaging hooks 82 as the supporting an pivot point. The outer periphery of the cutter circumferential rim 74 relative to the rocking axis 80 juts out to the upper edge of the mounting port 68. This arrangement restricts a portion of the outer cutter assembly 70 adjacent to the center (the central axis 52) of the cutter frame 66 from rising while allows the portion of the outer cutter assembly 70 to move down. Here, a portion of the cutter circumferential rim 74 that is adjacent to the center (the central axis 52) of the cutter frame 66 is resiliently elastically pushed up by a pushup plate 92, which will be discussed later, thus allowing the portion of the outer cutter assembly 70 adjacent to the center (the central axis 52) to be elastically pushed down.

The inner cutter 84 rotates in slidable contact with the inner surface of the outer cutter 72, thereby cutting hair introduced into the hair introduction openings of the outer cutter 72. The outer cutter 72 and the inner cutter 84 constitute the cutter unit. The boss 86 is secured to the bottom surface of the inner cutter 84, and the boss 86 has the concavity 88, which opens downward and into which the connecting driven shaft 62 of the universal joint 54 is locked (refer to FIGS. 6 to 9).

A cutter retaining plate 90 is detachably installed to the inner surface of the cutter frame 66. As illustrated in FIGS. 3, 4, 9 and 10, the cutter retaining plate 90 retains the pushup plate 92, which elastically pushes up the cutter circumferential rim 74 of the outer cutter assembly 70. More specifically, the annular pushup plate 92 is mounted on a cylindrical guide 90C formed at the center of the cutter retaining plate 90 with an outer cutter float spring 94 made of a coil spring interposed therebetween, thus abutting three ribs 92A, which are protrusively provided at regular intervals on the top surface of the pushup plate 92, against the bottom surface of the cutter circumferential rim 74 (refer to FIG. 6).

Thus, the three ribs 92*a* abut against the cutter circumferential rim 74 at the side adjacent to the center (the central axis 52) of the cutter frame 66. This causes a portion of each of the three outer cutter assemblies 70 adjacent to the center of the cutter frame 66 to be resiliently pushed up about each of the rocking axes 80. When the outer cutters 72 are pushed down against skin, the portions of the outer cutter assemblies 70 adjacent to the center of the cutter frame 66 move down about the rocking axes 80. At this time, the pushup plate 92 compresses the spring 94.

The cutter retaining plate 90 is detachably installed to the inner side of the cutter frame 66 by a Y-shaped removable plate 96. More specifically, a cylinder (collet) 96A with slits, which rotatably penetrates the guide 90C of the cutter retaining plate 90 (FIG. 3), is formed at the center of the removable plate 96. A hook provided at the distal end of the cylinder 96A is locked to the upper end of the guide 90C. The distal ends of legs 96B of the removable plate 96 (FIG. 10), which radially extend, can be engaged with or disengaged from three fixed ribs 66A, which are protrusively provided on the inner surface of the cutter frame 66, in the circumferential direction.

Further, the cylinder 96A of the removable plate 96 engages with a central projection 66B (FIGS. 6 and 9) protrusively provided at the center of the bottom surface of the cutter frame 66 (on the central axis 52) so as to position the removable plate 96. Three troughs 90A formed in the cutter retaining plate 90 (FIG. 10) engage with the upper edges of the ribs 66A thereby to position the cutter retaining plate 90.

As illustrated in FIG. 3, the head holder 50 has an opening 50A opposing the boss 48A positioned at the center of the waterproof plate 48, and a capping member 98 comes in slidable contact with the top surface surrounding the opening 50A. The capping member 98 is secured to the boss 48A by screwing a screw 98A penetrating the capping member 98 from above into the boss 48A. The central bottom surface of the head holder 50 is pressed upward by a coil spring 98B, which surrounds the boss 48A of the waterproof plate 48 and which is compressively installed between the waterproof plate 48 and the boss 48A. As a result, the central portion of the head holder 50 is vertically sandwiched between the capping member 98 and the coil spring 98B, allowing the head holder 50 to rock in a direction in which the central axis 52 tilts.

Figure 10:
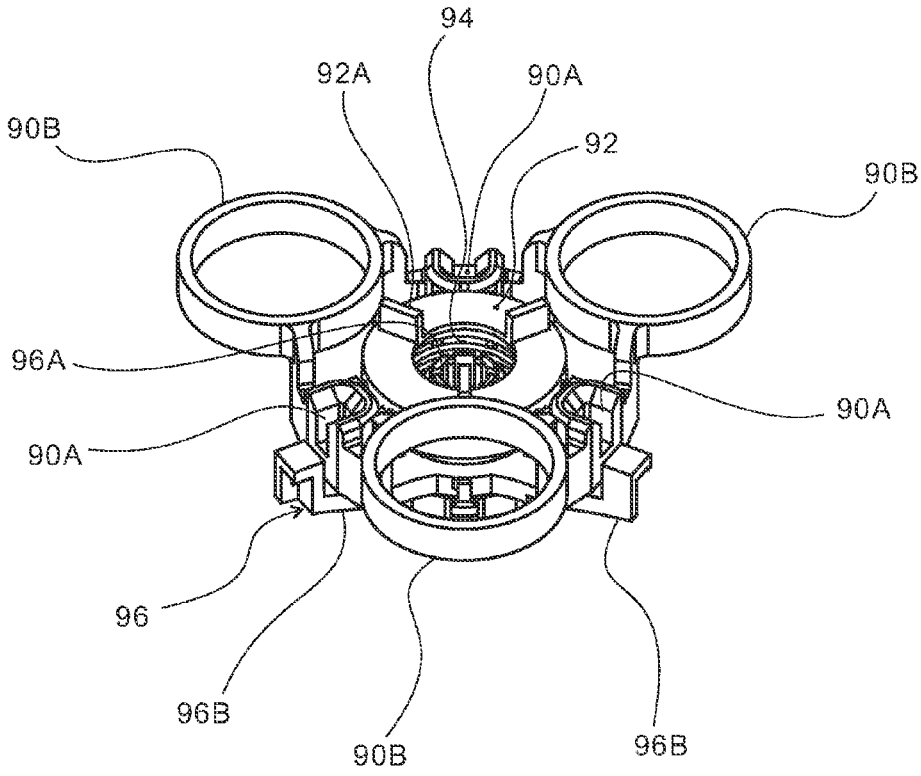
FIG. 10 is a perspective view of a removable assembly including a cutter retaining plate.

Three inner cutter fall proof rings 90B surrounding the bosses 86 of the inner cutters 84 of the cutter unit are integrally formed with the cutter retaining plate 90 (FIG. 10). These rings 90B prevent the inner cutters 84 from falling off when the head unit 26 is attached or detached or opened or closed in a state where the three cutter units have been attached to the head unit 26 and the cutter retaining plate 90 has been secured to the cutter frame 66.

The head unit 26 constructed as described above is attached to the head holder 50 by a hinge 100, so that the head unit 26 can be opened and closed. More specifically, the hinge 100 formed of a substantially U-shaped member swingably retained on the edge of the cutter frame 66 is retained by inserting the hinge 100 into a groove formed in the head holder 50. A portion of the edge of the head holder 50 on the opposite side from the hinge 100 can be locked by a locking device 102 provided on the head holder 50.

In the present embodiment, the cutter circumferential rim 74 of the outer cutter assembly 70 can be rocked about the rocking axis 80 (FIG. 5), and the side of the cutter circumferential rim 74 adjacent to the center of the head (adjacent to the central axis 52) is resiliently pushed up by the rib 92A of the pushup plate 92 (FIGS. 3, 4, 6 and 10). When, therefore, the top surface (the shaving surface) of the head unit 26 is pressed against skin, the cutter circumferential rim 74 rocks while pressing the pushup plate 92 down. At this time, if only one outer cutter assembly 70 out of three assemblies is pressed down, then the pushup plate 92 merely tilts, exerting no influences on the forces for depressing the remaining outer cutter assemblies 70. Thus, the three outer cutter assemblies 70 independently rock without influencing each other, so that the three outer cutter assemblies 70 do not interfere with each other in shaving performance.

Further, the top surface of the cutter frame 66 is exposed among the mounting ports 68 of the three cutter circumferential rims 74 (FIGS. 1, 4 and 5). Hence, when the head unit 26 slides on skin while one cutter circumferential rim 74 is deeply down, a bulging portion of the skin is temporarily supported by the top surface of the cutter frame 66 between the adjacent cutter circumferential rims 74. In other words, the difference in height between the adjacent cutter circumferential rims 74 is accommodated by the top surface of the cutter frame 66, thus allowing the head unit 26 to smoothly move.

The invention claimed is:

1. A rotary electric shaver comprising:

a plurality of cutter units each having an outer cutter assembly and an inner cutter, each of the outer cutter assemblies include an outer cutter and a circumferential rim secured to the outer cutter, the inner cutters being rotated by a motor, each of the inner cutters being in resilient contact with an inner surface of a respective one of the outer cutters each one of the outer cutter assemblies being movably retained in a respective mounting port formed in a cutter frame;

a pushup plate which contacts at least one of the outer cutter assemblies from below to push up the at least one outer cutter assembly;

a cutter retaining plate which is retained by the cutter frame and which is positioned below the pushup plate; and an outer cutter float spring which is compressively interposed between the cutter retaining plate and the pushup plate to impart an upward restoring tendency to the pushup plate.

2. The rotary electric shaver according to claim 1, wherein each one of the respective outer cutter assemblies is attached to the respective mounting port of the cutter frame such that each one of the plurality of the outer cutter assemblies can be rocked on a rocking axis which is orthogonal to a straight line extending from a center of the cutter frame in a radial direction and which passes a center of a respective one of the plurality of outer cutters.

3. The rotary electric shaver according to claim 2, wherein each of the plurality of cutter circumferential rims has a pair of engaging hooks, said engaging hooks are protrusively provided adjacent to the rocking axis of at least one of the outer cutters and are positioned symmetrically with respect to the center of the outer cutter assembly, the engaging hooks locking on the respective mounting port of the cutter frame.

4. The rotary electric shaver according to claim 1, wherein said cutter retaining plate retains a removable plate, and said removable plate is locked onto a fixed rib secured to the inner surface of the cutter frame.

5. The rotary electric shaver according to claim 1, wherein the cutter retaining plate is formed integrally with an inner cutter fall proof ring for preventing any one of the inner cutters of the cutter unit from falling off.

6. The rotary electric shaver according to claim 1, wherein said pushup plate abuts a bottom surface of at least one of the cutter circumferential rims of at least one of the plurality of outer cutter assemblies at an edge thereof adjacent to a center of the cutter frame.

7. The rotary electric shaver according to claim 1, wherein the pushup plate includes an underside portion disposed to contact the outer cutter float spring.

8. The rotary electric shaver according to claim 7, wherein the pushup plate includes protrusions on a side opposite to the underside portion.

* * * * *